US005467077A

United States Patent [19]

Wunderlich et al.

[11] Patent Number: 5,467,077

[45] Date of Patent: Nov. 14, 1995

[54] METHOD AND MEANS FOR INDICATING AN APPLIANCE CONDITION

[75] Inventors: Daniel F. Wunderlich; Nedra A. Herr, both of Newton; Donald N. Shannon, Ankeny; L. Dean Kuhn, Newton, all of Iowa

[73] Assignee: Maytag Corporation, Newton, Iowa

[21] Appl. No.: 168,664

[22] Filed: Dec. 16, 1993

Related U.S. Application Data

[63] Continuation-in-part of Ser. No. 22,958, Feb. 25, 1993.

[51] Int. Cl.[6] ..... G08B 21/00

[52] U.S. Cl. ..... 340/635; 34/89; 34/533

[58] Field of Search ..... 340/635, 691, 340/331, 525; 34/88, 89, 524, 528, 533

[56] References Cited

U.S. PATENT DOCUMENTS

| | | | |
|---|---|---|---|
| 3,499,230 | 7/1968 | Slugantz | 34/45 |
| 3,503,062 | 3/1970 | Witzke | 340/331 |
| 3,707,776 | 2/1973 | Schmidgall | 34/533 |
| 3,710,138 | 1/1973 | Cotton | 307/118 |
| 3,762,064 | 10/1973 | Offutt | 34/45 |
| 3,832,629 | 8/1974 | Cernek, Jr. | 340/691 |
| 4,215,486 | 8/1980 | Heyer et al. | 34/45 |
| 4,338,596 | 7/1982 | Huber | 340/691 |
| 4,385,452 | 5/1983 | Deschaaf et al. | 34/53 |
| 4,418,398 | 11/1983 | Hornung | 395/700 |
| 4,554,565 | 11/1985 | Kito et al. | 503/701 |
| 4,723,656 | 2/1988 | Kiernan et al. | 206/333 |
| 4,763,425 | 8/1988 | Grennan | 34/552 |
| 4,763,493 | 8/1988 | Nishite et al. | 68/12.27 |
| 4,803,854 | 2/1989 | Kikuchi et al. | 68/12.27 |
| 4,893,484 | 1/1990 | Takahashi et al. | 68/12.01 |
| 4,922,242 | 5/1990 | Parker | 345/106 |
| 4,955,213 | 9/1990 | Ohsugi et al. | 68/12.12 |
| 5,128,616 | 7/1992 | Palmer | 324/435 |
| 5,270,520 | 12/1993 | Barzilai et al. | 219/501 |

*Primary Examiner*—John K. Peng
*Assistant Examiner*—Julie Lieu
*Attorney, Agent, or Firm*—Zarley, McKee, Thomte, Voorhees, & Sease

[57] ABSTRACT

A display is provided for indicating changes between first and second operating conditions in an appliance such as a clothes dryer. A sensing circuit senses changes in operating conditions within the appliance. The sensing circuit creates an intermittent sensing signal which is sent to a light. The light blinks at a frequency corresponding to the frequency of the sensor signal. A second light remains lit continuously during the operation of the appliance.

6 Claims, 3 Drawing Sheets

METHOD AND MEANS FOR INDICATING AN APPLIANCE CONDITION

This is a continuation-in-part of application Ser. No. 08/022,958 filed Feb. 25, 1993.

BACKGROUND OF THE INVENTION

This invention relates to a method and means for indicating an appliance condition. While the present invention can be used for indicating a number of different types of conditions within an appliance, one particular application for the present invention is the indication of the degree of dampness of a fabric within a fabric or clothes dryer.

Present clothes dryers do not include any means for visibly indicating the fabric dryness condition to the operator during the drying cycle.

Therefore, a primary object of the present invention is the provision of a method and means for indicating an appliance condition.

A further object of the present invention is the provision of a method and means for indicating the moisture level of fabric in a fabric dryer.

A further object of the present invention is the provision of an improved method and means for indicating an appliance condition which is reliable over a long period of time and which minimizes the need for repair or maintenance.

A further object of the present invention is the provision of a means for indicating an appliance condition which is economical to manufacture, durable in use, and efficient in operation.

SUMMARY OF THE INVENTION

The present invention achieves these objects with an indicator system particularly adapted for indicating the moisture level of a fabric in a clothes dryer during the drying portion of the electronic control cycle. However, this indicator system could be used in a variety of appliance display applications, including the indication of temperature levels, timer conditions, or numerous other conditions which might exist within an appliance.

The present invention includes a sensing circuit for sensing changes in the operating conditions of the appliance. The sensing circuit then produces an intermittent sensor signal having a frequency which is directly proportional to the progressive changes in the condition of the appliance.

An indicator circuit includes at least one indicator and is connected to the sensing circuit for receiving the intermittent sensor signal. The indicator circuit causes the indicator to be actuated at a frequency directly proportional to the frequency of the intermittent sensor signal.

DETAILED DESCRIPTION OF THE PREFERRED EMBODIMENT

Figure 1:
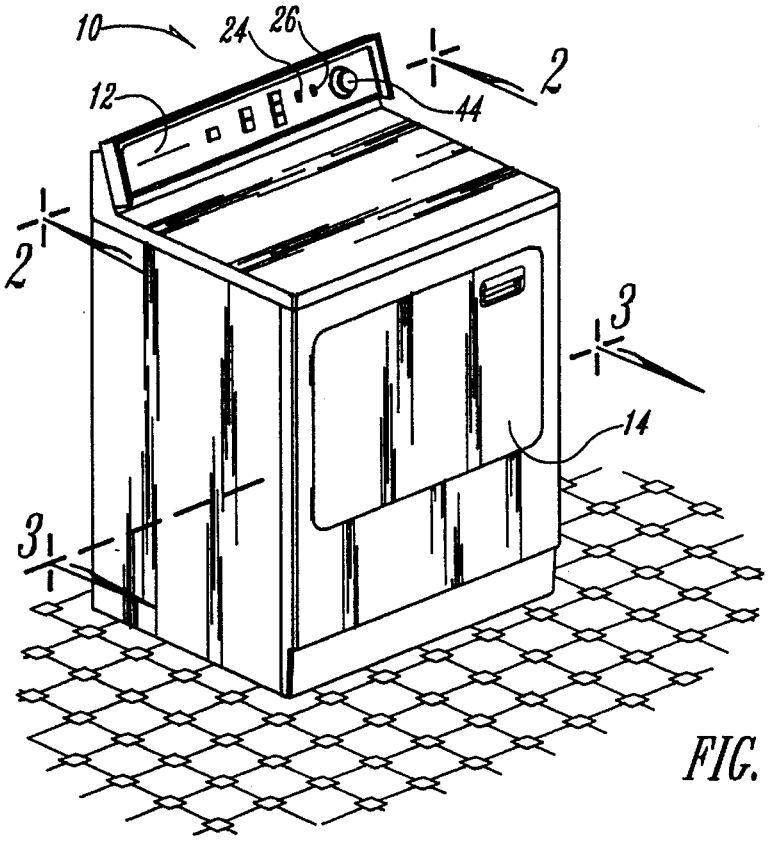
FIG. 1 is a perspective view of a clothes dryer utilizing the indicator of the present invention.
Figure 2:
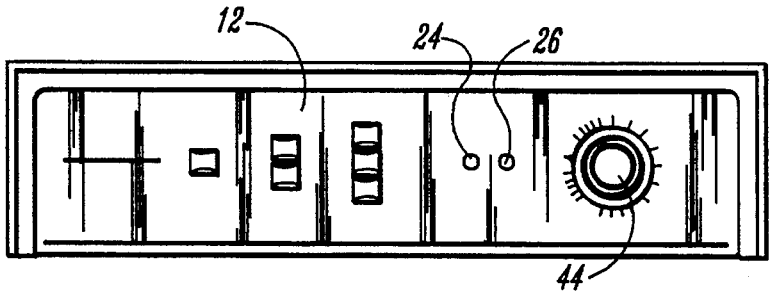
FIG. 2 is a front elevational detail view taken along Line 2—2 of FIG. 1.

Referring to the drawings the numeral 10 generally designates a typical clothes dryer. While the present invention is shown to be used for indicating the moisture level in fabrics in a clothes dryer, the present invention can also be used to indicate numerous other conditions which might occur in various appliances. For example it could be used as a coin drop indicator in a coin operated appliance for indicating to the user when the appropriate coins have been dropped into the appliance. It also could be used to indicate time of operation or the cycle in which the appliance is operating. Almost any condition within an appliance could be indicated with the present invention.

Figure 3:
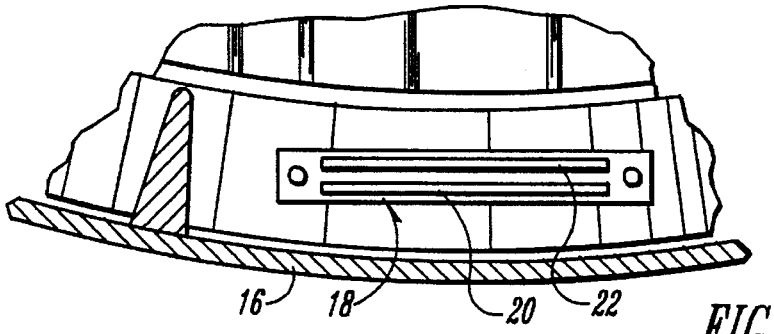
FIG. 3 is an enlarged sectional detail of the tumbler drum within the dryer, taken along Line 3—3 of FIG. 1.

Clothes dryer 10 includes a control panel 12, an access door 14, and a drying drum 16 (FIG. 3) located internally of the dryer 10. Within the drying drum 16 is a dampness or moisture sensor 18 comprising a pair of spaced apart sensor bars 20, 22. Sensor bars 20, 22 are electrical contacts which when intermittently bridged by damp fabrics complete a circuit and cause an intermittent sensor signal. When the fabrics are wet they create electrical continuity across sensor bars 20, 22. When the fabrics are dry they do not make electrical continuity across sensor bars 20, 22. Thus, initially, when the fabrics are wet they create a high frequency intermittent sensor signal as they tumble into contact with bars 20, 22. As the fabrics dry the frequency of the intermittent sensor signal diminishes until there is no sensor signal when the clothes are substantially dry.

The intermittent sensor signal causes a neon lamp 24 on control panel 12 to blink intermittently. A second neon light 26 on control panel 12 remains continuously lit until the cool down portion of the electronic control cycle is achieved.

Figure 4:
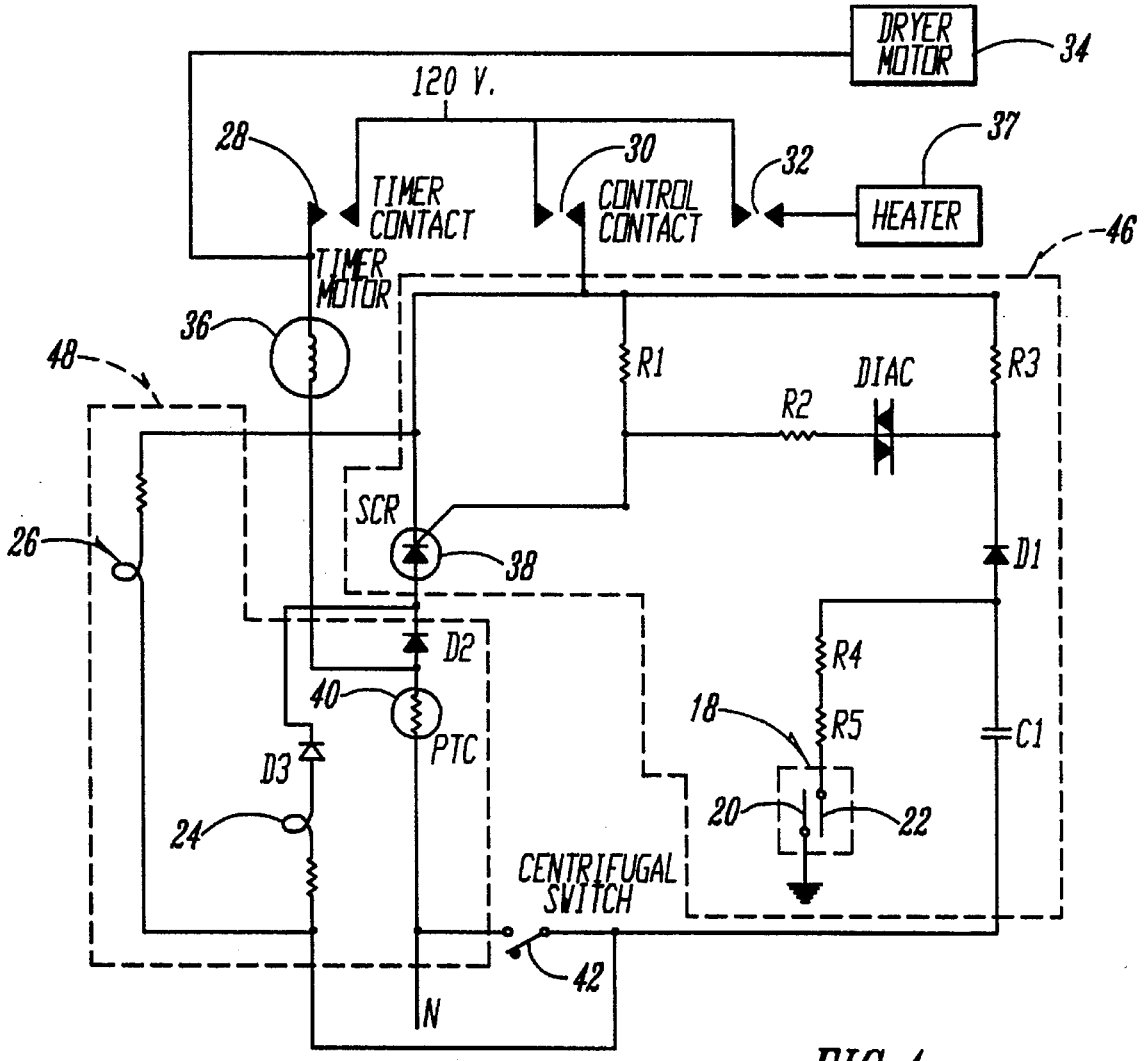
FIG. 4 is a schematic view of the electrical circuitry of the present invention.

In operation the clothes dryer 10 and moisture level indicating neon lights 24, 26 are controlled by a control which is manually set by means of dial 44 on control panel 12. The dial 44 can be turned to place the clothes dryer 10 in either a timer mode or an automatic electronic sensing mode. In the timer mode the drying operation is merely timed for a specified period of time determined by the setting of dial 44. In the automatic electronic sensing mode, the present invention is utilized to sense and display or indicate the moisture content of the fabrics being dried and to cause the clothes dryer 10 to automatically shut off after the drying operation has been completed. The circuitry for operating in both the timer mode and the automatic electronic sensing mode is shown in FIG. 4.

In the time mode, both a timer contact 28 and a heater contact 32 are moved to their closed positions. A control contact 30 remains in its open position. The moisture level indicating neon lights 24, 26 are not used in the timer mode of operation. The closing of contacts 28, 32, causes current to be introduced to a timer motor 36, dryer motor 34 and a heater 37 respectively. The heater 37 comprises an electric resistance or gas heater for supplying fabric drying heat to the drying drum 16. The timer motor 36 continues to operate throughout the time mandated by the set position of dial 44. Throughout this time the drying drum 16 continues to rotate and the heater 37 continues to provide heat to the fabrics being dried. The rotation of drum 16 by dryer motor 34 causes a centrifugal switch 42 associated with motor 34 to be closed. As the timer motor 36 completes its cycle, it causes the timer and heater contacts 28 and 32 to move to their open position thereby causing the heater 37 and the dryer motor 34 to be sequentially deactuated. Deactuation of the dryer motor 34 causes centrifugal switch 42 to move to its open position.

In order to operate the dryer 10 in the automatic electronic sensing mode, the dial 44 is placed in the proper position to set the timer motor 36 for a particular period of time and also to close all three timer contacts 28, 30, and 32. An SCR 38 is provided in the circuitry, and is normally in an open circuit condition which prevents the introduction of current from control contact 30 to the PTC thermistor 40 or to the neon light 24.

In the automatic electronic sensing mode, during the initial operation of the clothes dryer 10 the moist fabrics will engage the contact bars 20, 22 creating intermittent pulses of closed circuit conditions across the bars 20, 22. This causes intermittent pulses of current to be introduced to the gate of the SCR 38, thereby causing the SCR 38 to be moved from its normal open circuit condition to its closed circuit condition. This causes the PTC thermistor 40 to be energized to a high resistance state. The relatively high resistance state of thermistor 40 causes the voltage to timer motor 36 to be reduced to such a level that motor 36 stops operating. At the same time the intermittent on-off operation of SCR 38 causes the neon lamp 24 to blink on and off at a frequency corresponding to the intermittent bridging of contacts 20, 22 caused by wet fabrics striking them. As the fabrics become dryer, the frequency of the blinking diminishes until the neon lamp 24 remains off.

The closing of contact 30 also causes current to be introduced continuously to neon lamp 26 which remains continuously lit to indicate that the fabrics are not completely dried. The timer motor 36 remains deactuated during the entire time that moist fabrics bridge or short circuit sensor bars 20, 22. As the fabrics become nearly dry they stop short circuiting the sensor bars 20, 22, thereby causing SCR 38 to remain in its open circuit condition. As a result the PTC thermistor 40 is turned off.

However, the fabrics at this time are usually not completely dry and it is desirable to keep the dryer operating for an additional period of time. This is accomplished by the timer motor 36, which begins running again because it is no longer under the influence of PTC thermistor 40. During the time that the timer motor 36 continues to run, the neon lamp 24 is off, but the neon lamp 26 continues to be actuated through control contact 30. As the timer motor 36 advances through its cycle, it causes timer contacts 28, 30, and 32 to be opened, thereby deactuating dryer motor 34, heater 37, and neon lamp 26.

The numeral 46 generally designates a sensor circuit for sensing the changing moisture conditions of the fabrics and for creating an intermittent sensor signal having a frequency directly proportioned to the amount of dampness sensed in the fabrics. The numeral 48 generally designates a display circuit for receiving the intermittent sensor signal from the sensor circuit and for actuating neon lamp 24 intermittently and neon lamp 26 continuously. The specific circuitry shown for circuits 46, 48 can be varied without detracting from the invention.

The result of this configuration is that when the fabrics are initially being dried, the neon lamp 26 is on continuously and the neon lamp 24 blinks at a high frequency. As the fabrics become drier, the frequency of the blinking diminishes until the clothes are nearly dry, at which time the neon lamp 24 stops blinking. The neon lamp 26 continues to be lit while the timer motor 44 advances through its cycle. This indicates to the user that the clothes are nearly dry, and that the dryer will be operating for a short period of time before shutting off. As the timer motor 36 reaches the end of its cycle, the timer contacts 28, 30, and 32 are opened to shut down all systems of the dryer. Both indicator lamps 24, 26 are then unlit, and the operator knows that the clothes or fabrics are dry.

Figure 5:
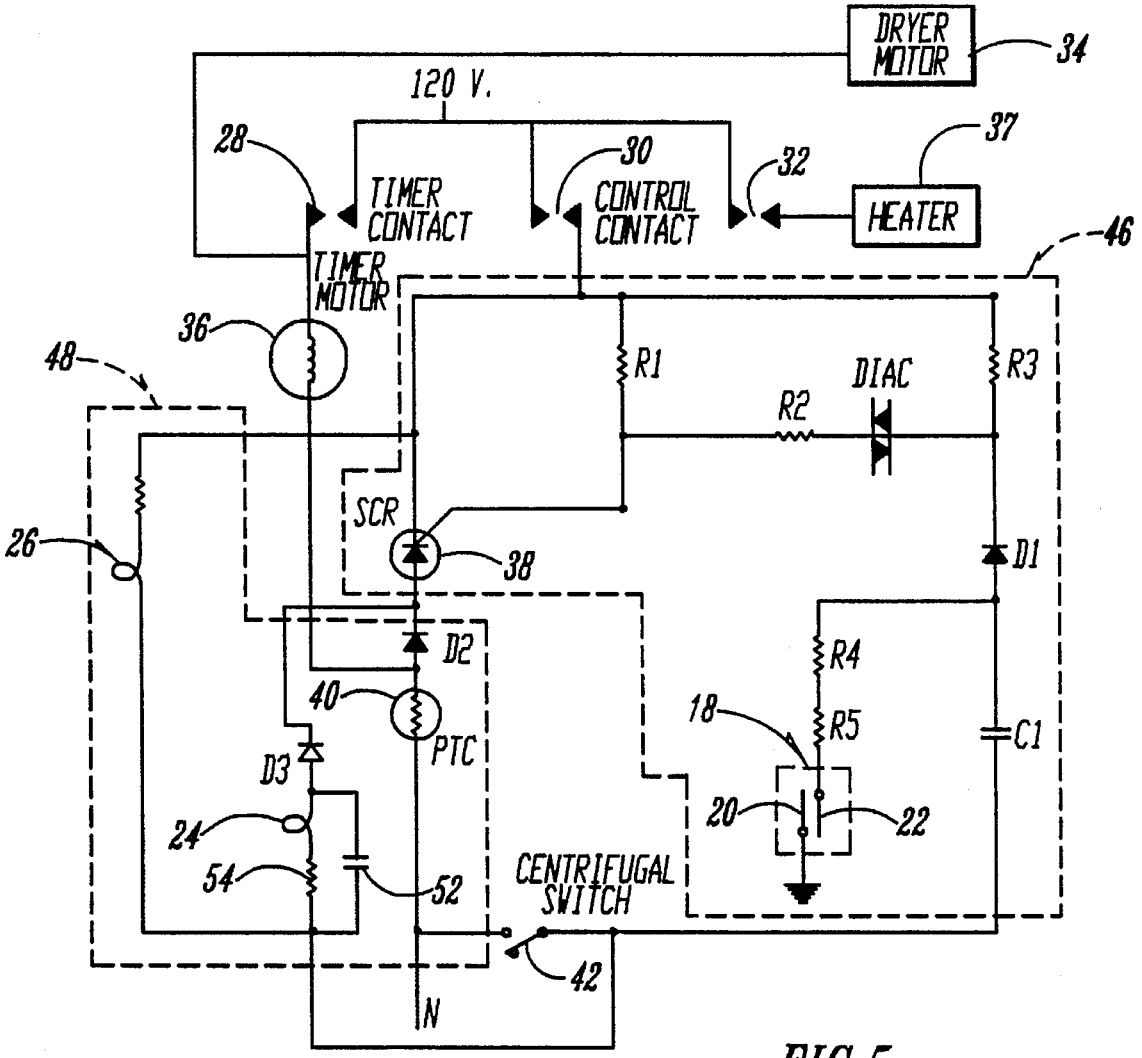
FIG. 5 is a schematic view of the electrical circuitry of a modified form of the present invention.

Yet another embodiment of the instant invention is best shown in FIG. 5 and is designated by the numeral 50. With this arrangement, capacitor 52 will charge as the wet fabrics make intermittent contact with the sensor bars 20, 22 and the neon light 24 will remain lit continuously for a length of time proportional to the size of the capacitor 52. When the fabrics are dry, the neon light 24 will turn off but timer motor 36 will run since it is not under the influence of the PTC thermistor 40. As the timer motor 36 runs out to the end of the cycle, the neon lamp 26 will continue to be actuated, as previously described, through control contact 30. During the time between fabric contacts with sensor bars 20, 22, capacitor 52 will discharge through the neon light 24 to effectively keep the neon light 24 continuously on as opposed to blinking. Examples of preferred sizes for capacitor 52, neon lamp 24 and resistor 54 are capacitor 52: at least 250 microfarads; lamp 24: ⅓ watt, and resistor 54: 27K ohms.

The present invention is highly reliable, having a minimum number of working parts. While neon lamps 24, 26 are preferred, other visual indicators such as LED's or lamps could also be used. Sound indicators such as buzzers or chimes could also be used. The device is very simple in operation and very simple in construction. The cost of manufacturing the device is low.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

We claim:

1. Apparatus for displaying the progressive drying of initially moist fabrics from a wet condition to a dry condition within a rotating drum of a drying appliance, said apparatus comprising:

a moisture sensing circuit including a pair of spaced apart sensor bars in said drum, said moisture sensing circuit being capable of creating an intermittent sensor signal having a high frequency when said sensor bars are bridged by said moist fabrics and having a progressively lower frequency down to a frequency of zero corresponding to the progressive drying of said fabrics to said dry condition;

a power source;

an electrically actuatable indicator connected to said power source;

a gate connected between said power source and said indicator and also being connected to said sensor bars of said moisture sensing circuit, said gate being adapted to change from a normally open circuit condition preventing electrical connection between said power source and said indicator to a closed circuit condition causing electrical connection from said power source to said indicator in response to said sensor signal and at a frequency corresponding to said frequency of said sensor signal whereby said indicator will be actuated at a frequency corresponding to said frequency of said sensor signal.

2. Apparatus according to claim 1 and further comprising a timer motor connected to said power source, a thermistor connected between said timer motor and ground, said thermistor connected to said gate for receiving said sensor signal therefrom and for deactivating said timer motor when said frequency of said sensor signal is above a predetermined frequency.

3. Apparatus according to claim 2 and further comprising a second indicator connected to said power source for being continuously actuated, said timer motor having a predetermined cycle and being adapted to disconnect said second indicator from said power source at the end of said predetermined cycle.

4. A method for displaying the progressive drying of initially moist fabrics from a wet condition to a dry condition within a rotating drum of a drying appliance, said method comprising:

creating an intermittent sensor signal with a moisture sensing circuit including a pair of spaced apart sensor bars within said drum by bridging said sensor bars with damp fabrics during rotation of said drum, said intermittent sensor signal having a high frequency when said fabrics are in said wet condition and a progressively decreasing frequency down to a zero frequency corresponding to the progressive drying of said fabrics to said dry condition;

connecting an actuatable indicator to a power source;

connecting a gate between said power source and said indicator;

connecting said sensor bars of said moisture sensing circuit to said gate;

changing said gate from an open circuit condition preventing actuation of said indicator to a closed circuit condition connecting said indicator to said power source for actuating said indicator;

said changing of said gate being done in response to said sensor signal from said sensor bars and at the same frequency as said frequency of said sensor signal, whereby said indicator will be actuated at a frequency corresponding to said frequency of said sensor signal.

5. A method according to claim 4 and further comprising connecting a timer motor and a thermistor in series with said power source, connecting said thermistor to said gate for energizing of said thermistor whenever said gate is in said closed circuit condition, deactuating said timer motor in response to energizing of said thermistor, and activating said motor after said sensor signal has reached a predetermined frequency.

6. A method according to claim 5 and further comprising actuating a second indicator continuously while said fabrics are changing from said wet condition to said dry condition and while said timer motor is actuated.

* * * * *